US008284136B2

(12) United States Patent
Kang et al.

(10) Patent No.: US 8,284,136 B2
(45) Date of Patent: Oct. 9, 2012

(54) PIXEL CIRCUIT, ORGANIC LIGHT EMITTING DISPLAY, AND DRIVING METHOD THEREOF

(75) Inventors: Chul-Kyu Kang, Yongin (KR); Bo-Yong Chung, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 259 days.

(21) Appl. No.: 12/869,721

(22) Filed: Aug. 26, 2010

(65) Prior Publication Data

US 2011/0164016 A1 Jul. 7, 2011

(30) Foreign Application Priority Data

Jan. 5, 2010 (KR) ..... 10-2010-0000571

(51) Int. Cl.
*G09G 3/32* (2006.01)

(52) U.S. Cl. ..... 345/82; 315/169.3

(58) Field of Classification Search ..... 345/76–99, 345/204–212, 690–699; 315/169.3
See application file for complete search history.

(56) References Cited

U.S. PATENT DOCUMENTS

| | | | | |
|---|---|---|---|---|
| 7,710,368 | B2 * | 5/2010 | Chung | 345/82 |
| 8,149,186 | B2 * | 4/2012 | Kim | 345/76 |
| 2009/0109150 | A1 * | 4/2009 | Han et al. | 345/82 |
| 2009/0167364 | A1 | 7/2009 | Bramante et al. | |

FOREIGN PATENT DOCUMENTS

| | | |
|---|---|---|
| KR | 2009-0071385 | 7/2009 |

OTHER PUBLICATIONS

KIPO Registration Determination Certificate, dated Sep. 30, 2011, for Korean Priority Patent Application No. 10-2010-0000571, 5 pages.

* cited by examiner

*Primary Examiner* — Kent Chang
*Assistant Examiner* — Gerald Oliver
(74) *Attorney, Agent, or Firm* — Christie, Parker & Hale, LLP

(57) ABSTRACT

A pixel circuit includes: an OLED; a second transistor including gate, first, and second terminals coupled to a first scan line, a data line, and a first node, respectively; a fourth transistor including gate, first, and second terminals coupled to a third scan line, the first node, and a second node, respectively; a third transistor including gate, first, and second terminals coupled to a second scan line, a reference power source, and the second node, respectively; a fifth transistor including gate, first, and second terminals coupled to a light emission control line, a third node, and an anode of the OLED, respectively; a first capacitor coupled between the first and second nodes; a second capacitor coupled between the second and third nodes; and a first transistor including gate, first, and second terminals coupled to the first node, a first power source, and the third node, respectively.

20 Claims, 7 Drawing Sheets

① INITIALIZATION PERIOD

② DATA WRITING AND Vth COMPENSATION PERIOD

③ LIGHT EMISSION PERIOD

① DATA WRITING AND INITIALIZATION PERIOD

② Vth COMPENSATION PERIOD

③ LIGHT EMISSION PERIOD

PIXEL CIRCUIT, ORGANIC LIGHT EMITTING DISPLAY, AND DRIVING METHOD THEREOF

CROSS-REFERENCE TO RELATED PATENT APPLICATION

This application claims priority to and the benefit of Korean Patent Application No. 10-2010-0000571, filed on Jan. 5, 2010, in the Korean Intellectual Property Office, the entire disclosure of which is incorporated herein by reference.

BACKGROUND

1. Field

Embodiments of the present invention relate to a pixel circuit, an organic light emitting display, and a driving method thereof.

2. Description of the Related Art

Flat panel displays such as Liquid Crystal Display (LCD), Plasma Display Panel (PDP) and Field Emission Display (FED) have been developed to overcome some of the shortcomings of Cathode Ray Tube (CRT) displays. Among these flat panel displays, an organic light emitting display is particularly spotlighted as a next-generation display for its excellent light emitting efficiency, brightness, wide viewing angle, and fast response time.

An organic light emitting display displays an image by using Organic Light Emitting Diodes (OLEDs) which generate light by the recombination of electrons and holes. The organic light emitting display has merits such as fast response time and low power consumption.

SUMMARY

Aspects of embodiments according to the present invention are directed toward a pixel circuit, an organic light emitting display and a method thereof for solving the problems associated with increasing the size of an organic light emitting display by separating the initialization period from the threshold voltage compensation period.

According to an aspect of embodiments according to the present invention, there is provided a pixel circuit including an organic light emitting diode; a second transistor including a gate terminal, a first terminal, and a second terminal coupled to a first scan line, a data line, and a first node, respectively; a fourth transistor including a gate terminal, a first terminal, and a second terminal coupled to a third scan line, the first node, and a second node, respectively; a third transistor including a gate terminal, a first terminal, and a second terminal coupled to a second scan line, a reference power source, and the second node, respectively; a fifth transistor including a gate terminal, a first terminal, and a second terminal coupled to a light emission control line, a third node, and an anode of the organic light emitting diode, respectively; a first capacitor coupled between the first node and the second node; a second capacitor coupled between the second node and the third node; and a first transistor including a gate terminal, a first terminal, and a second terminal coupled to the first node, a first power source, and the third node, respectively, the first transistor being configured to supply a current to the organic light emitting diode.

The pixel circuit may be configured to sequentially receive a first scan signal, a second scan signal, and a third scan signal from the first, second, and third scan lines respectively.

The pixel circuit may be configured to receive the second scan signal one horizontal time period after a start of the first scan signal, and to receive the third scan signal two horizontal time periods after a start of the second scan signal.

The second transistor may be configured to apply a data signal from the data line to the first node when a first scan signal is applied to the first scan line.

The third transistor may be configured to apply a voltage of the first power source to the second node when a second scan signal is applied to the second scan line.

The fourth transistor may be configured to electrically couple the first node and the second node when a third scan signal is applied to the third scan line.

The fifth transistor may be configured to supply the current to the organic light emitting diode when a light emission control signal is applied to the light emission control line.

The pixel circuit may be configured to receive, during a first period, a data signal from the data line, the first scan signal, the second scan signal, and the light emission control signal each having a first voltage level, and the third scan signal having a second voltage level; to receive, during a second period, the first scan signal, the third scan signal, and the light emission control signal each having the second voltage level, and the second scan signal having the first voltage level; and to receive, during a third period, the light emission control signal having the first voltage level, and the first scan signal, the second scan signal, and the third scan signal each having the second voltage level.

The first voltage level may be a turn-on level of the first, second, third, fourth, and fifth transistors, and the second voltage level may be a turn-off level of the first, second, third, fourth, and fifth transistors.

The first, second, third, fourth, and fifth transistors may be N-type metal oxide semiconductor transistors.

According to another aspect of embodiments according to the present invention, there is provided an organic light emitting display including a scan driver configured to supply scan signals to scan lines and to supply light emission control signals to light emission control lines; a data driver configured to supply data signals to data lines; and a plurality of pixel circuits each located at crossing regions of the scan lines, the light emission control lines, and the data lines, wherein each of the pixel circuits includes an organic light emitting diode; a second transistor including a gate terminal, a first terminal, and a second terminal coupled to a first scan line of the scan lines, a data line of the data lines, and a first node, respectively; a fourth transistor including a gate terminal, a first terminal, and a second terminal coupled to a third scan line of the scan lines, the first node, and a second node, respectively; a third transistor including a gate terminal, a first terminal, and a second terminal coupled to a second scan line of the scan lines, a reference power source, and the second node, respectively; a fifth transistor including a gate terminal, a first terminal, and a second terminal coupled to a light emission control line of the light emission control lines, a third node, and an anode of the organic light emitting diode, respectively; a first capacitor coupled between the first node and the second node; a second capacitor coupled between the second node and the third node; and a first transistor including a gate terminal, a first terminal, and a second terminal coupled to the first node, a first power source, and the third node, respectively, the first transistor being configured to supply a current to the organic light emitting diode.

The scan driver may be configured to output first, second, and third scan signals from among the scan signals from the first, second, and third scan lines, respectively.

The scan driver may be configured to output the second scan signal after delaying the second scan signal for one horizontal time period after a start of the first scan signal, and to output the third scan signal after delaying the third scan signal for two horizontal time periods after a start of the second scan signal.

The organic light emitting display may further include emission control lines, wherein the scan driver, the data driver, and the emission control driver may be configured to: during a first period where a data signal is applied from the data line, apply a first scan signal from among the scan signals, a second scan signal from among the scan signals, and the light emission control signal from among the light emission control signals, each of the first scan signal, the second scan signal, and the light emission control signal having a first voltage level, and apply a third scan signal having a second voltage level from among the scan signals; during a second period, apply the first scan signal, the third scan signal, and the light emission control signal each having the second voltage level, and apply the second scan signal having the first voltage level; and during a third period, apply the light emission control signal having the first voltage level, and apply the first scan signal, the second scan signal, and the third scan signal each having the second voltage level.

The first voltage level may be a turn-on level of the first, second, third, fourth, and fifth transistors, and the second voltage level may be a turn-off level of the first, second, third, fourth, and fifth transistors.

According to another aspect of embodiments according to the present invention, there is provided a method of driving a pixel circuit which includes an organic light emitting diode; a second transistor including a gate terminal, a first terminal, and a second terminal coupled to a first scan line, a data line, and a first node, respectively; a fourth transistor including a gate terminal, a first terminal, and a second terminal coupled to a third scan line, the first node, and a second node, respectively; a third transistor including a gate terminal, a first terminal, and a second terminal coupled to a second scan line, a reference power source, and the second node, respectively; a fifth transistor including a gate terminal, a first terminal, and a second terminal coupled to a light emission control line, a third node, and an anode of the organic light emitting diode, respectively; a first capacitor coupled between the first node and the second node; a second capacitor coupled between the second node and the third node; and a first transistor including a gate terminal, a first terminal, and a second terminal coupled to the first node, a first power source, and the third node, respectively, the first transistor being configured to supply a current to the organic light emitting diode, the method including writing data to the pixel circuit and initializing the pixel circuit by applying a data signal from the data line, and turning on the second, third, and fifth transistors, and turning off the fourth transistor, wherein the second, third, and fifth transistors are turned on by respectively applying a first scan signal, a second scan signal and a light emission control signal each having a first voltage level, and the fourth transistor is turned off by applying a third scan signal having a second voltage level; compensating for a threshold voltage of the first transistor by turning off the second transistor, the fourth transistor, and the fifth transistor and turning on the third transistor, wherein the second transistor, the fourth transistor, and the fifth transistor are turned off by respectively applying the first scan signal, the third scan signal, and the light emission control signal each having the second voltage level, and the third transistor is turned on by applying the second scan signal having the first voltage level; and lighting the organic light emitting diode by turning on the fifth transistor and turning off the second, third, and fourth transistors, wherein the fifth transistor is turned on by applying the light emission control signal having the first voltage level, and the second, third, and fourth transistors are turned off by respectively applying the first scan signal, the second scan signal, and the third scan signal of the second voltage level.

The first voltage level may be a turn-on level of the first, second, third, fourth, and fifth transistors, and the second voltage level may be a turn-off level of the first, second, third, fourth, and fifth transistors.

The first, second, and third scan signals may be sequentially applied.

The second scan signal may be applied one horizontal time period after a start of the first scan signal, and the third scan signal may be applied two horizontal time periods after a start of the second scan signal.

The first, second, third, fourth, and fifth transistors may be N-type metal oxide semiconductor transistors.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
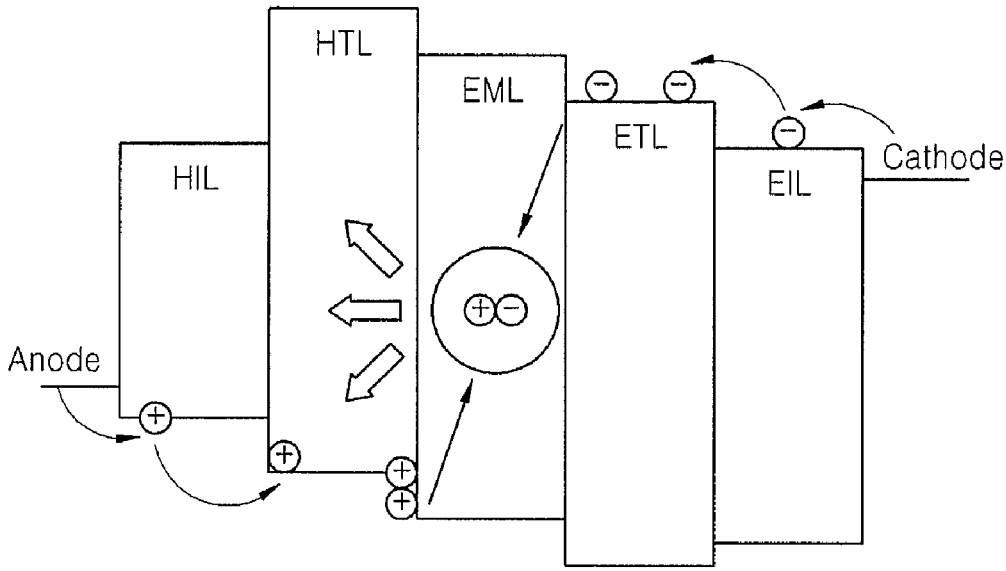
FIG. 1 is a conceptual diagram of an organic light emitting diode.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

Generally, an organic light emitting display emits light by electrically exciting a fluorescent organic compound, and is designed to display an image by driving a plurality of organic light emitting cells arranged in a matrix form with a voltage or current. Since an organic light emitting cell has properties of a diode, the organic light emitting cell is referred to as an organic light emitting diode (OLED).

FIG. 1 is a conceptual diagram of an OLED.

Referring to FIG. 1, the OLED includes an anode (composed of, e.g., ITO), an organic thin film and a cathode (composed of, e.g., metal). The organic thin film includes an emitting layer (EML), an electron transport layer (ETL) and a hole transport layer (HTL) for improving the light emitting efficiency through the improvement of balance of electrons and holes. In addition, the organic thin film may further include a hole injecting layer (HIL) and/or an electron injecting layer (EIL).

An OLED having a structure as described above may be driven according to a passive matrix driving method or an active matrix driving method. According to the passive matrix driving method, the positive and negative electrodes are formed to cross each other, and a line is selected for the driving. The active matrix driving method uses a thin firm transistor (TFT) or a metal-oxide-semiconductor field-effect transistor (MOSFET). According to the active matrix driving method, the TFT is coupled to an indium tin oxide (ITO) pixel electrode, and the driving is performed according to a voltage maintained by a capacitor coupled to a gate of the TFT. Among the kinds of active matrix driving methods, there is a voltage driving method. According to the voltage driving method, a signal is inputted for storing and maintaining a voltage in the capacitor, wherein the signal is in a form of a voltage.

Figure 2:
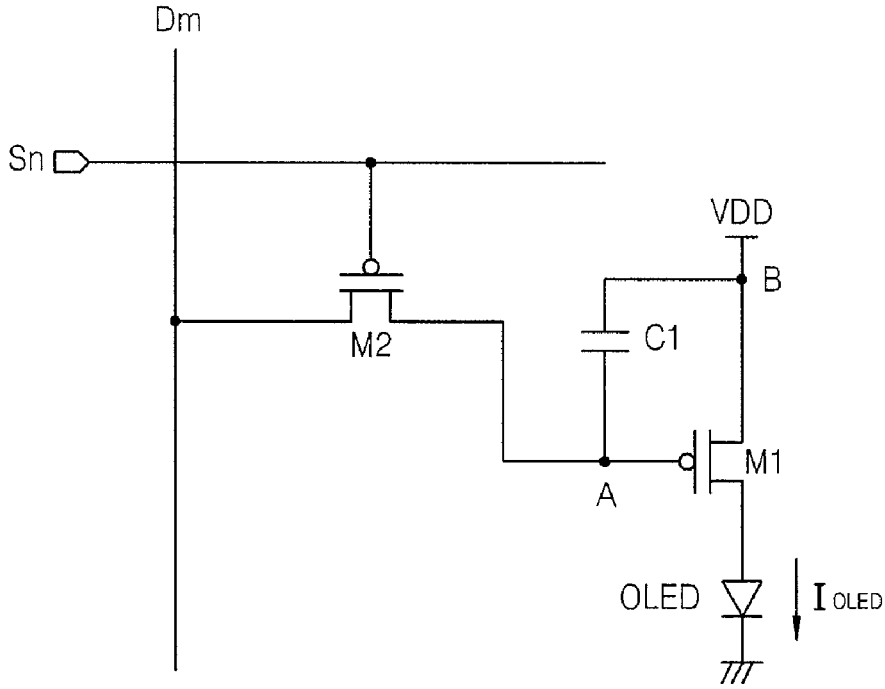
FIG. 2 is a circuit diagram of a pixel circuit that may be driven using a voltage driving method.

FIG. 2 is a circuit diagram of a pixel circuit that may be driven using the voltage driving method.

Referring to FIG. 2, a switching transistor M2 is turned on by a scan signal from a scan line Sn, and a data voltage from a data line Dm is transferred to a gate of a driving transistor M1 in response to the turn-on of the switching transistor M2, and a potential difference of the data voltage and a power supply voltage VDD is stored in a capacitor C1 coupled between the gate and a source of the driving transistor M1. Due to the potential difference (e.g., between the gate and the source of the driving transistor), a driving current $I_{OLED}$ flows to the OLED, and thus the OLED emits light. According to a level of the data voltage applied at this time, a display with gradation of light and shade (or dark) is possible.

However, a plurality of driving transistors M1 of a plurality of pixel circuits P may have different threshold voltages. If the threshold voltages of the driving transistors M1 are different from one another, an amount of current outputted from each of the driving transistors of the pixel circuits P is different, and thus the image may not be uniformly displayed. The threshold voltage variation of the driving transistors M1 may become more serious as the size of the organic light emitting display is increased (e.g., as the number of pixels is increased). This may cause degradation of picture quality of the organic light emitting display. Therefore, the threshold voltages of the driving transistors in the pixel circuits should be compensated for to provide an organic light emitting display having uniform picture quality.

There are various circuits used for compensating for the threshold voltage of the transistor (e.g., the driving transistor) in the pixel circuit. Most of these circuits perform an initialization operation and the transistor threshold voltage compensation operation concurrently (or simultaneously) for a constant period of time. In this case, unwanted light emission may occur during the initialization, and thus contrast ratio (C/R) may become worse (e.g., decrease). Also, as the organic light emitting display increases in resolution and in size, the load of initialization time increases (e.g., more time is required to initialize the larger number of pixels). Therefore, when concurrently (or simultaneously) performing the initialization and the driving transistor threshold voltage compensation, the time substantially required for the initialization may be relatively shortened (e.g., to maintain a higher frame rate, the time allowed for initialization may be shortened, thereby allowing each pixel less time to initialize). However, because the initialization operation and the threshold voltage compensation voltage occur concurrently, the shortened initialization time may not be sufficient time for accurate threshold voltage compensation. One way to solve or reduce this problem is to provide a pixel circuit which operates with separate initialization and threshold voltage compensation times (which may overlap).

Figure 3:
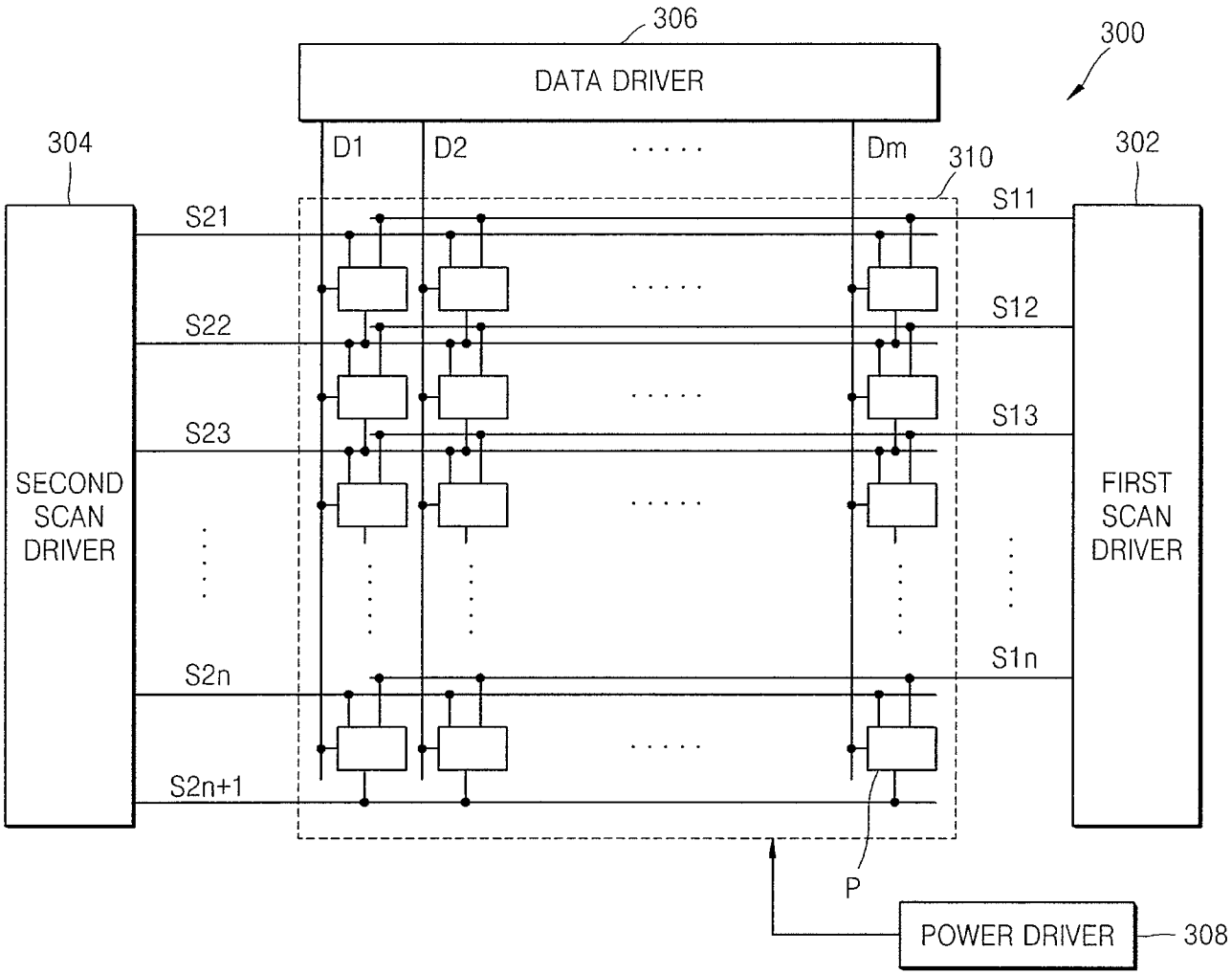
FIG. 3 is a schematic diagram illustrating an organic light emitting display according to one embodiment of the present invention.

FIG. 3 is a schematic diagram illustrating an organic light emitting display 300 according to one embodiment of the present invention.

Referring to FIG. 3, the organic light emitting display 300 according to one embodiment includes a display unit 310, a first scan driver 302, a second scan driver 304, a data driver 306, and a power driver 308.

The display unit 310 includes n×m pixel circuits P, n+1 second scan lines S21 to S2*n*+1, m data lines D1 to Dm, n first scan lines S11 to S1*n*, a first power line (e.g., see FIG. 4) and a second power line (not shown). Each of the n×m pixel circuits P includes an organic light emitting diode (not shown). The n+1 second scan lines S21 to S2*n*+1 are arranged in (or extend in) a row direction and transfer second scan signals. The m data lines D1 to Dm are arranged in (or extend in) a column direction and transfer data signals. The n first scan lines S11 to Sin are arranged in (or extend in) a row direction and transfer first scan signals. The first and second power lines transfer power.

The display unit 310 displays an image by lighting the organic light emitting diodes (not shown) according to the second scan signals, the data signals, the first scan signals, a first power ELVDD (e.g., from a first power source) and a second power ELVSS (e.g., from a second power source).

The first scan driver 302 is coupled to the first scan lines S11 to S1*n* and applies the first scan signals to the display unit 310.

The second scan driver 304 is coupled to the second scan lines S21 to S2*n*+1 and applies the second scan signals to the display unit 310.

The data driver 306 is coupled to the data lines D1 to Dm and applies the data signals to the display unit 310. The data driver 306 supplies data voltages to the pixel circuits P during a programming period.

The power driver 308 applies the first power ELVDD and the second power ELVSS to each pixel circuit P. Herein, the second power ELVSS may be grounded.

Figure 4:
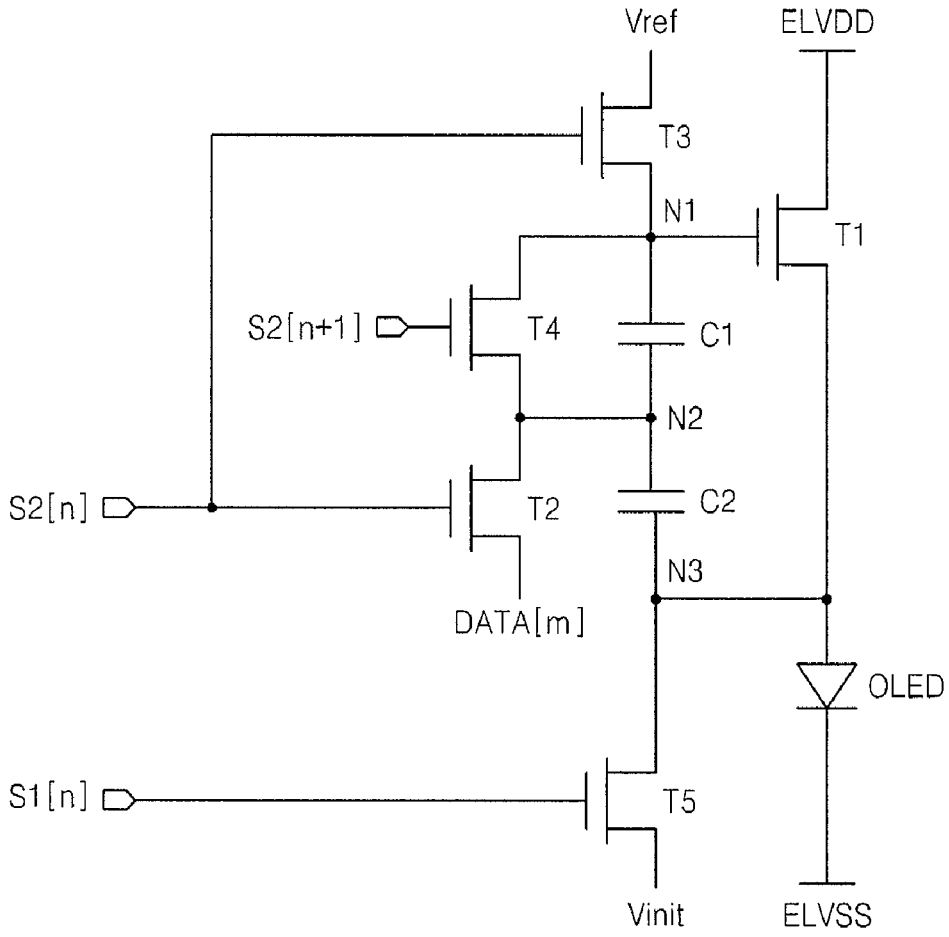
FIG. 4 is a circuit diagram illustrating a pixel circuit that may be used as the pixel circuit illustrated in FIG. 3, according to one embodiment of the present invention.

FIG. 4 is a circuit diagram illustrating a pixel circuit that may be used as the pixel circuit P illustrated in FIG. 3, according to one embodiment of the present invention. For the sake of convenience, FIG. 4 illustrates the pixel circuit P receiving an nth second scan signal S2[*n*] from the nth second scan line S2*n*, an n+1th second scan signal S2[*n*+1] from the n+1th second scan line S2*n*+1, an nth first scan signal S1[*n*] from the nth first scan line S1*n* and the mth data signal DATA[m] from the mth data line Dm.

Referring to FIG. 4, an anode of the OLED is coupled to a third node N3, and a cathode is coupled to the second power ELVSS (or the second power source). In this form, the OLED generates light with a brightness (e.g., a predetermined brightness) corresponding to the amount of current supplied by a first transistor T1, i.e., a driving transistor.

A gate terminal, a drain terminal, and a source terminal of a second transistor T2 are respectively coupled to the nth second scan line S2*n*, the data line Dm, and a second node N2. The second transistor T2 is turned on when the second transistor T2 receives an nth second scan signal S2[*n*], i.e., a voltage signal of a high level, from the nth second scan line S2*n*, and transfers the data signal DATA[m], i.e., a voltage signal (e.g., a predetermined voltage signal), from the data line Dm to the second node N2.

A gate terminal, a drain terminal, and a source terminal of a third transistor T3 are respectively coupled to the nth second scan line S2*n*, a first reference voltage Vref (e.g., a first reference voltage source), and a first node N1. The third transistor T3 is turned on when the third transistor T3 receives the nth second scan signal S2[*n*], i.e., the high level voltage signal, from the nth second scan line S2*n*, and a voltage of the first reference voltage Vref is applied to the first node N1.

A gate terminal, a drain terminal, and a source terminal of a fifth transistor T5 are respectively coupled to the nth first scan line S1*n*, a second reference voltage Vinit, and the third node N3. The fifth transistor T5 is turned on when the fifth transistor T5 receives the first scan signal S1[*n*], i.e., the high level voltage signal, from the nth first scan line S1*n*, and a voltage of the second reference voltage Vinit is applied to the third node N3.

A gate terminal, a drain terminal, and a source terminal of a fourth transistor T4 are respectively coupled to the n+1th second scan line S2*n*+1, the first node N1, and the second node N2. The fourth transistor T4 is turned on when the fourth transistor T4 receives the n+1th second scan signal S2[*n*+1], i.e., the high level voltage signal, from the n+1th second scan line S2*n*+1, and electrically couples the first node N1 and the second node N2.

A first capacitor C1 is coupled between the first node N1 and the second node N2, and a second capacitor C2 is coupled between the second node N2 and the third node N3.

A gate terminal and a drain terminal of a first transistor T1 are respectively coupled to the first node N1 and the first power ELVDD. A source electrode of the first transistor T1 is commonly coupled to the third node N3 and the anode of the OLED. The first transistor T1 supplies the driving current $I_{OLED}$ to the OLED. Herein, the driving current $I_{OLED}$ is determined according to a voltage difference Vgs between the gate terminal and the source electrode of the first transistor T1, i.e., the driving transistor. When the voltage Vgs between the gate terminal and the source electrode of the first transistor T1 is greater than a critical (or threshold) voltage Vth, the first transistor T1 supplies the driving current $I_{OLED}$ to the OLED.

In an embodiment of the present invention, all of the first to fifth transistors T1 to T5 are NMOS transistors. An NMOS transistor is an N-type metal oxide semiconductor transistor that is turned off and turned on when a level state (or voltage level) of a control signal (e.g., a voltage signal) is at a low level (e.g., a low voltage level) and at a high level (e.g., a high voltage level), respectively. In comparison with a PMOS transistor, the NMOS transistor has a faster operation speed, and thus it is used in one embodiment for manufacturing (or suitable for use in) a large screen display.

Figure 5:
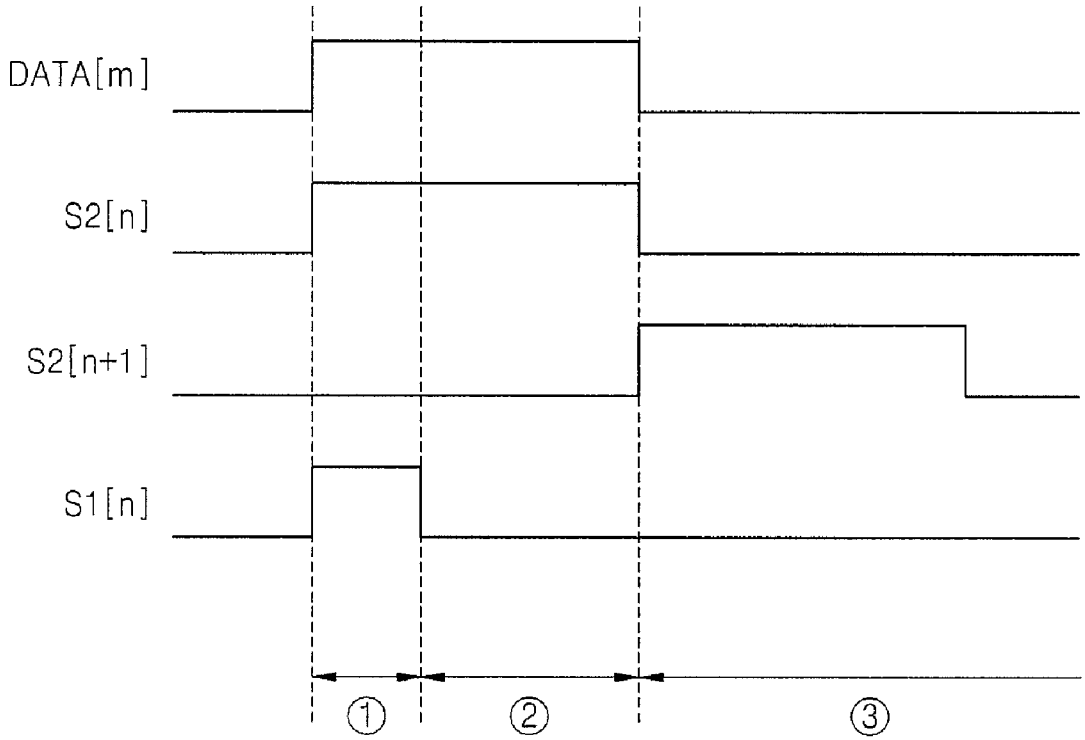
FIG. 5 is a timing diagram of driving waveforms that are used with the pixel circuit illustrated in FIG. 4 in one embodiment of the present invention.

A driving process of the pixel circuit P illustrated in FIG. 4 is described in detail with reference to FIG. 5. FIG. 5 is a timing diagram of driving waveforms that are used with the pixel circuit of FIG. 4 in one embodiment of the present invention.

Referring to FIG. 5, a first period is an initialization period where the nth first scan signal S1[*n*] applied to the nth first scan line S1*n* and an nth second scan signal S2[*n*] applied to the nth second scan line S2*n* become a high level (or have a high voltage level), and thus the first node N1, the second node N2, and the third node N3 are initialized to the first reference voltage Vref, the data signal DATA[m], and the second reference voltage Vinit, respectively. A second period is a data writing and threshold voltage compensation period for compensating for the threshold voltage Vth of the driving transistor, i.e., the first transistor T1. In the second period, the second scan signal S2[*n*] applied to the nth second scan line S2*n* remains at a high level and the first scan signal S1[*n*] applied to the nth first scan line S1*n* transitions to a low level, and thus the data signal DATA[m] is stored in the first capacitor C1 and a voltage corresponding to the threshold voltage Vth of the first transistor T1 is transferred to the third node N3. A third period is a light emitting period where the n+1th second scan signal S2[*n*+1] applied to the n+1th second scan line S2*n*+1 becomes a high level and the nth second scan signal S2[*n*] applied to the nth second scan line S2*n* transitions to a low level, and thus the current which corresponds to the voltage difference Vgs between the gate terminal and the source terminal of the first transistor T1, i.e., the driving current $I_{OLED}$, is supplied to the OLED so that the OLED emits light.

Referring to FIGS. 4 and 5, the switching operation and driving operation of the transistors in each period are described in detail.

In the first period, as the data signal DATA[m] is applied, when the first scan signal Si[n] applied to the nth first scan line Si n and the nth second scan signal S2[*n*] applied to the nth second scan line S2*n* are applied in a high level, the second transistor T2, the third transistor T3, and the fifth transistor T5 are turned on, and thus the second node N2, the first node N1 and the third node N3 are respectively initialized to the data signal DATA[m], the first reference voltage Vref, and the second reference voltage Vinit.

In the second period, as the data signal DATA[m] is applied, and when the nth second scan signal S2[*n*] applied to the nth second scan line S2*n* remains at a high level and the nth first scan signal S1[*n*] applied to the nth first scan line S1*n* transitions to a low level, the fifth transistor T5 is turned off, and thus a voltage corresponding to the threshold voltage Vth of the first transistor T1 is transferred to the third node N3. Herein, the voltage difference Vgs between the gate terminal and the source terminal of the first transistor T1 is Vdata−Vref+Vth. Herein, the first reference voltage Vref is a low voltage so that a current does not flow to the OLED, and the second reference voltage Vinit is sufficiently lower voltage than Vref−Vth. Accordingly, the above-mentioned voltages have a relationship wherein ELVDD>Vdata>Vref>Vinit.

In the third period, when the n+1th second scan signal S2[*n*+1] is applied to the n+1th second scan line S2*n*+1, the fourth transistor T4 is turned on, and the first node N1 and the second node N2 are short-circuited, and a higher voltage than the threshold voltage Vth of the first transistor T1 is applied so that the first transistor T1 is turned on. The driving current $I_{OLED}$ which flows to the OLED is determined according to the following Equation 1.

$$I_{OLED}=K(V_{gs}-V_{th})^2 \quad \text{Equation 1}$$

where K is a constant value determined by the mobility and parasitic capacitance of a driving transistor, and Vgs is the voltage difference between the gate terminal and the source terminal of the driving transistor, and the Vth is the threshold voltage of the driving transistor. Herein, the Vgs is a voltage difference between the first node N1 and the third node N3, i.e., the voltage difference between the gate terminal and the source terminal of the first transistor T1.

By applying the previously mentioned value of the Vgs to Equation 1, Equation 2 is obtained.

$$I_{OLED}=K(V_{data}-V_{ref}+V_{th}-V_{th})^2$$

$$I_{OLED}=K(V_{data}-V_{ref})^2 \quad \text{Equation 2}$$

Through Equation 2, it may be ascertained that the driving current $I_{DLED}$ which flows to the OLED is determined by the first reference voltage Vref and the data voltage Vdata. That is, it may be ascertained that the current flows regardless of (i.e., does not depend on) the threshold voltage Vth of the first transistor T1.

Figure 6:
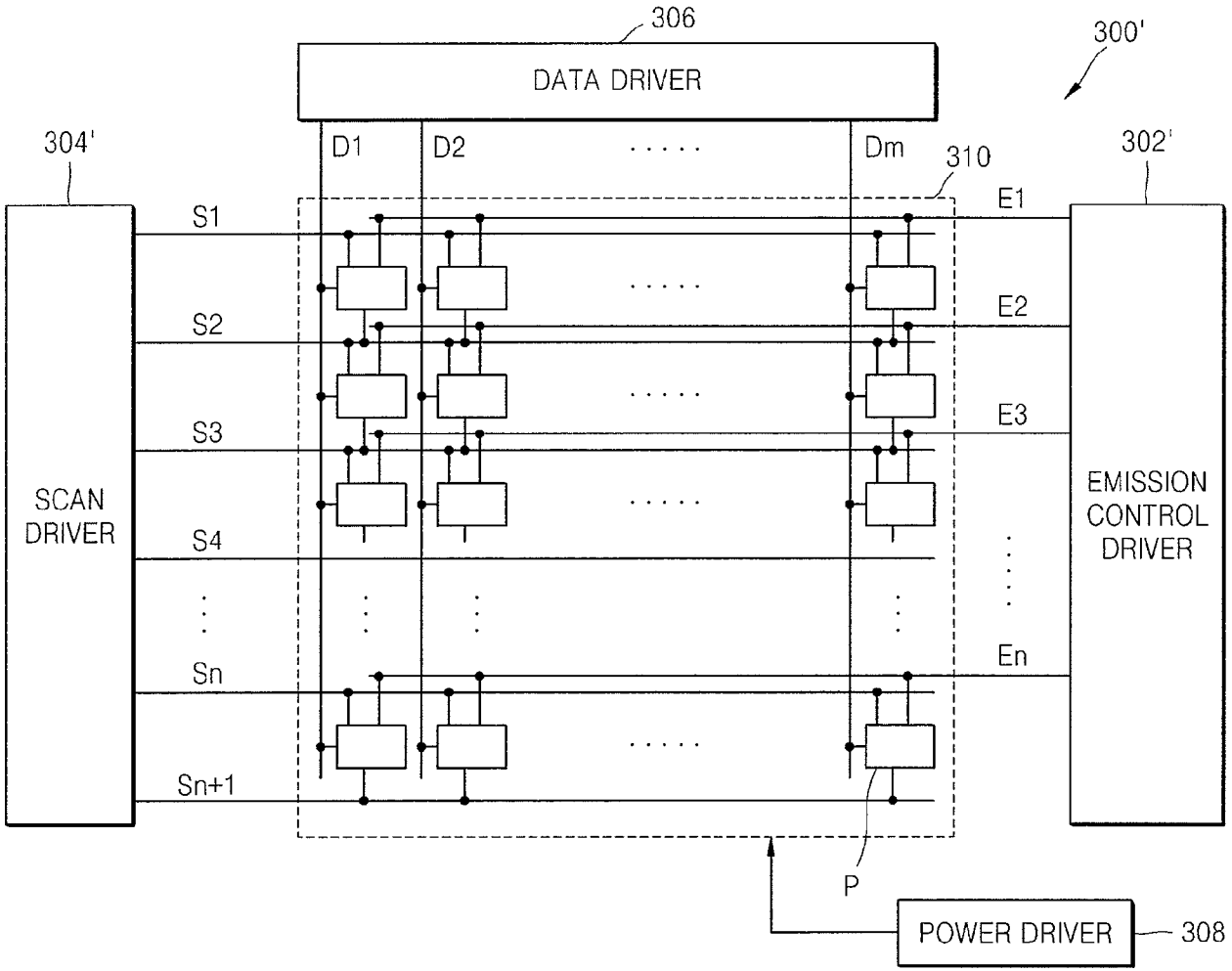
FIG. 6 is a schematic diagram illustrating an organic light emitting display according to one embodiment of the present invention.

FIG. 6 is a schematic diagram illustrating an organic light emitting display 300' according to one embodiment of the present invention. Detailed descriptions of some features that are similar to those previously discussed in reference to another embodiment will not be repeated.

Referring to FIG. 6, the organic light emitting display 300' according to one embodiment includes a display unit 310, a scan driver 304', an emission control driver 302', a data driver 306, and a power driver 308.

The display unit 310' includes n×m pixel circuits P, n+1 scan lines S1 to Sn+1, m data lines D1 to Dm, n light emission control lines E1 to En, a first power line (not shown) and a second power line (not shown). Each of the n×m pixel circuits P includes an organic light emitting diode (not shown). The n+1 scan lines S1 to Sn+1 are arranged in (or extend in) a row direction and transfer scan signals. The m data lines D1 to Dm are arranged in (or extend in) a column direction and transfer data signals. The n light emission control lines E1 to En are arranged in (or extend in) a row direction and transfer light emission control signals. The first and second power lines transfer power.

The display unit 310 displays an image by lighting the organic light emitting diodes according to the scan signals, the data signals, the light emission control signals, a first power ELVDD and a second power ELVSS.

The scan driver 304' is coupled to the scan lines 51 to Sn+1 and applies the scan signals to the display unit 310.

The emission control driver 302' is coupled to the light emission control lines E1 to En and applies the light emission control signals to the display unit 310.

Figure 7:
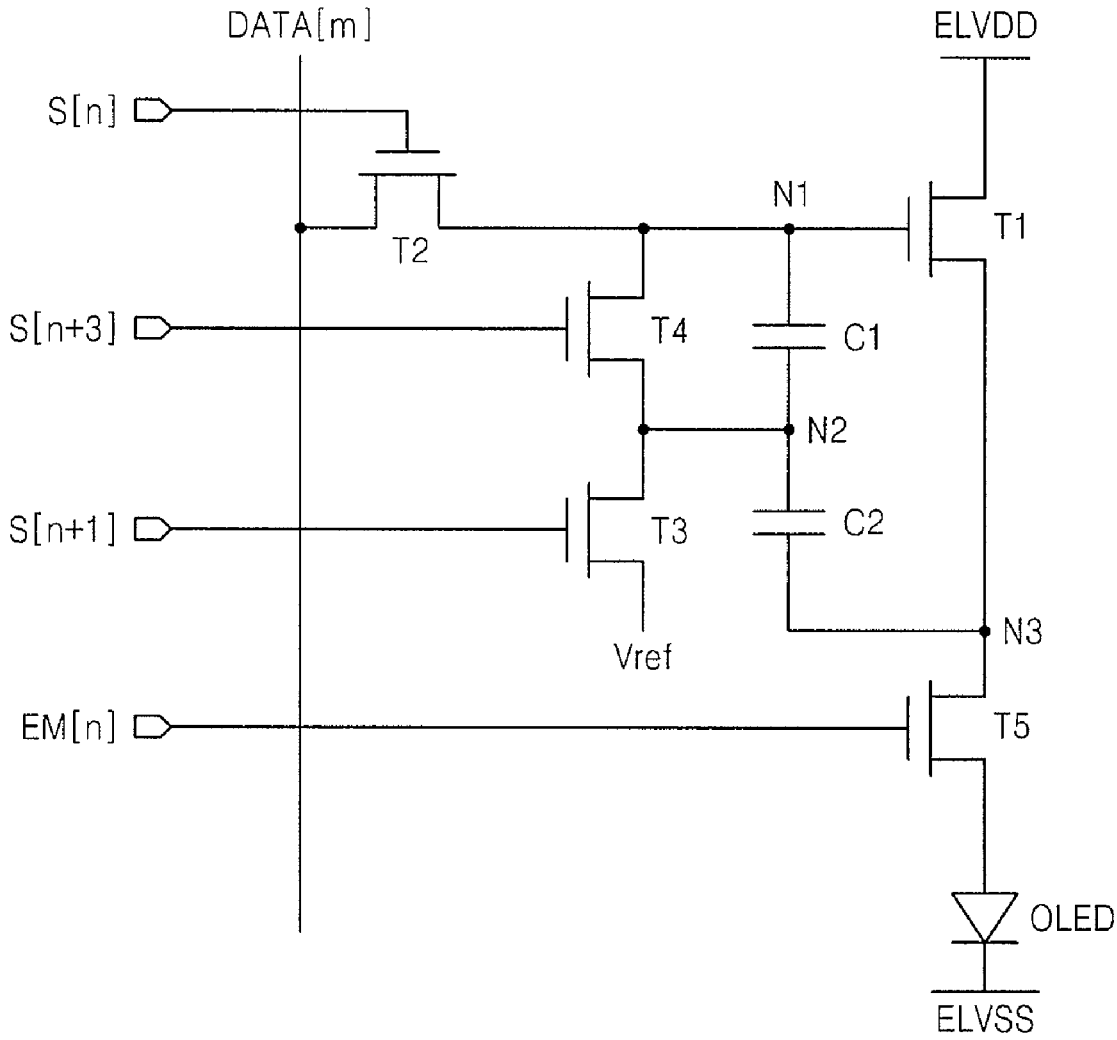
FIG. 7 is a circuit diagram illustrating another pixel circuit that may be used as the pixel circuit illustrated in FIG. 6, according to one embodiment of the present invention.

FIG. 7 is a circuit diagram illustrating a pixel circuit that may be used as the pixel circuit P of the display panel illustrated in FIG. 6, according to one embodiment of the present invention. In FIG. 7, for the sake of convenience, scan signals from the scan lines that are sequentially delayed and outputted are respectively illustrated as a first scan signal S[n], a second scan signal S[n+1], and a third scan signal S[n+3], and the pixel circuit P receives a light emission control signal EM[n] and an mth data signal DATA[m]. For example, when a pixel on the first row is driven, it receives the first scan signal from scan line S1, the second scan signal from scan line S2, the third scan signal from scan line S4, and the light emission control signal from the light emission control line E1.

Referring to FIG. 7, an anode of the OLED is coupled to a source terminal of a fifth transistor T5, and a cathode is coupled to a second power ELVSS. In this form, the OLED generates light with a brightness (e.g., a predetermined brightness) corresponding to the amount of current supplied by a first transistor T1, i.e., a driving transistor.

A gate terminal, a drain terminal, and a source terminal of a second transistor T2 are respectively coupled to the first scan line (e.g., S1), the data line Dm, and a first node N1. The second transistor T2 is turned on when the second transistor T2 receives a first scan signal S[n], i.e., a high level signal, from the first scan line, and transfers a data signal DATA[m] to the first node N1.

A gate terminal, a drain terminal, and a source terminal of a fourth transistor T4 are respectively coupled to the third scan line (e.g., S4), a second node N2, and the first node N1. The fourth transistor T4 is turned on when the fourth transistor T4 receives a third scan signal S[n+3], i.e., a high level signal, from the third scan line, and electrically couples the first node N1 and the second node N2.

A gate terminal, a drain terminal, and a source terminal of a third transistor T3 are respectively coupled to the second scan line (e.g., S2), a first reference voltage Vref, and the second node N2. The third transistor T3 is turned on when the third transistor T3 receives a second scan signal S[n+1], i.e., a high level signal, from the second scan line, and the first reference voltage Vref is applied to the second node N2.

A gate terminal, a drain terminal, and the source terminal of the fifth transistor T5 are respectively coupled to a light emission control line E1, the third node N3, and the anode of the OLED. The fifth transistor T5 is turned on when the fifth transistor T5 receives a light emission control signal EM[n], i.e., a high level signal, from the light emission control line E1, and transfers a driving current $I_{OLED}$ to the OLED.

A first capacitor C1 is coupled between the first node N1 and the second node N2, and a second capacitor C2 is coupled between the second node N2 and the third node N3. The first capacitor C1 maintains a voltage between the first node N1 and the second node N2, and the second capacitor C2 maintains a voltage between the second node N2 and the third node N3.

A gate terminal, a drain terminal, and a source terminal of the first transistor T1 are respectively coupled to the first node N1, a first power ELVDD, and the third node N3. When a voltage Vgs between the gate terminal and the source terminal of the first transistor T1 is greater than a threshold voltage Vth, the first transistor T1 transfers the driving current $I_{OLED}$ for driving the OLED.

In an embodiment of the present invention, all of the first to fifth transistors T1 to T5 are NMOS transistors. The NMOS transistor is an N-type metal oxide semiconductor transistor that is turned off and turned on when a level state (or voltage level) of a control signal is at a low level and at a high level, respectively. In comparison with a PMOS transistor, the NMOS transistor has a faster operation speed, and thus it is used in one embodiment for manufacturing (or are suitable for use in) a large screen display.

Figure 8:
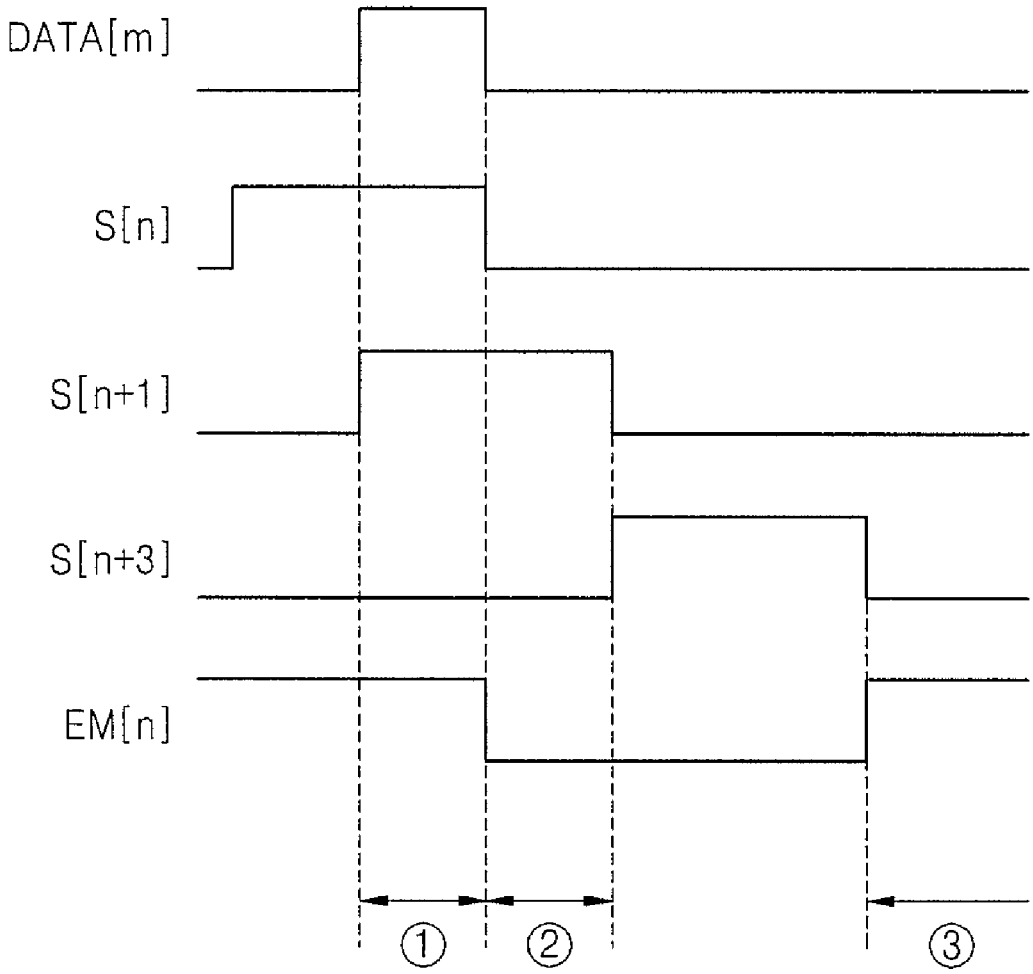
FIG. 8 is a timing diagram of driving waveforms that are used with the pixel circuit illustrated in FIG. 7 in one embodiment of the present invention.

A driving process of the pixel circuit P illustrated in FIG. 7 is described in detail with reference to FIG. 8. FIG. 8 is a timing diagram of driving waveforms that are used with the pixel circuit of FIG. 7 according to one embodiment of the present invention.

Referring to FIG. 8, the first scan signal S[n], the second scan signal S[n+1], and the third scan signal S[n+3] are outputted from the scan driver 304 after being delayed from one of the scan lines S1 to Sn+1. Herein, the second scan signal S[n+1] is outputted one horizontal time period 1H (e.g., one clock signal) after the start of the first scan signal S[n], and the third scan signal S[n+3] is outputted two horizontal time periods 2H after the start of the second scan signal S[n+1].

As illustrated in FIG. 8, according to a data signal DATA [m] applied during one horizontal time period, the first, second, and third scan signals S[n], S[n+1], and S[n+3] (each of which having a length of two horizontal time periods 2H) are applied. In a period where the first scan signal S[n] and the second scan signal S[n+1], which is delayed for one horizontal time period and then outputted, overlap in a high level and the light emission control signal Em[n] remains at a high level, e.g., during a first period, data writing and initializing operations are performed. Also, a period where the first scan signal S[n] and the light emission control signal Em[n] transition to a low level and the second scan signal S[n+1], which is delayed for 1 horizontal time period and then outputted, remains at a high level, e.g., a threshold voltage compensation period, is performed for one horizontal time period (1H). Accordingly, by increasing a high level maintaining period of the scan signal to be two horizontal periods (2H) or longer, the threshold voltage compensation period may be increased to be more than one horizontal period (1H). Therefore, in the case of driving the pixel circuit P at a high speed, the effect of the threshold voltage compensation (e.g., the time length of the threshold voltage compensation period) may be increased.

Referring to FIG. 8 again, the first period is a data writing and initialization period. In the first period, when a valid data signal DATA[m] is applied from the data line Dm, and the first scan signal S[n], the second scan signal S[n+1] and the light emission control signal EM[n] are applied in a high level, the second transistor T2, the third transistor T3, and the fifth transistor T5 are turned on. As the second transistor T2 is turned on, the data signal DATA[m] is transferred to the first node N1. As the third transistor T3 is turned on, the voltage of the first reference voltage Vref is applied to the second node N2. Also, as the light emission control signal EM[n] is applied at a high level, the driving current flows to the OLED and voltage of the anode of the OLED is applied to the third node N3, wherein the voltage of the anode of the OLED is a value wherein the OLED emits light. Accordingly, the first, second and third nodes N1, N2 and N3 are respectively initialized to a voltage corresponding to the data signal DATA[m], the voltage of the first reference voltage Vref, and the voltage of the anode of the OLED during the emission of light.

A second period is the threshold voltage compensation period for compensating for a threshold voltage Vth, where the second scan signal S[n+1] remains at a high level (e.g., a high voltage level), and the first scan signal S[n] and the light emission control signal EM[n] transition to a low level (e.g., a low voltage level). The third transistor T3 remains in a turned-on state, and the second and fifth transistors T2 and T5 are turned off. Accordingly, the voltages of the first and the second nodes N1 and N2 do not change, and they keep the previously applied voltages Vdata and Vref. In accordance with the turning off of the fifth transistor T5, the voltage of the third node N3 is increased from the anode voltage to Vdata−Vth.

A third period is a light emitting period where when the light emission control signal EM[n] transitions to a high level, and the first to third scan signals are applied in a low level, all of the second to fourth transistors T2 to T4 are turned off and the fifth transistor T5 is turned on. Prior to the third period, when the third scan signal S[n+3] is applied in a high level, the fourth transistor T4 is turned on, and thus the first node N1 and the second node N2 are short-circuited, and the voltage difference between the gate terminal and the source terminal of the first transistor T1, i.e., the Vgs, is made to be Vref−Vdata+Vth and stored into the second capacitor C2. Also, if the light emission control signal EM[n] is applied in a high level, the Vgs of the first transistor T1 increases over the threshold voltage so that the driving current $I_{OLED}$ flows to the OLED.

By applying the previously mentioned value of the Vgs to Equation 1, the driving current $I_{DLED}$ is represented as the following Equation 3.

$$I_{OLED}=K(V_{ref}-V_{data})^2 \quad \text{Equation 3}$$

Through Equation 3, it may be ascertained that the driving current $I_{OLED}$ which flows to the OLED is determined by the first reference voltage Vref and the data voltage Vdata. That is, it may be ascertained that the current flows regardless of (e.g., does not depend on) the threshold voltage Vth of the first transistor T1.

Also, unlike the pixel circuit P illustrated in FIGS. 4 and 5, the pixel circuit P illustrated in FIGS. 6 and 7 performs the initialization with the threshold voltage compensation operation. Accordingly, when a large-sized panel with a high resolution is driven, a potential shortcoming of insufficient threshold voltage compensation time due to shortened scan time may be overcome. This shortcoming causes degradation of the threshold voltage compensation performance, which results in non-uniform brightness. Also, without using a scan signal and the other scan signal lines, i.e., S1 and S2, using only one scan line for driving one pixel circuit (or row of pixel circuits) may be suitable for realizing a large-sized display. Also, by using the light emission control signal, the light emission period may be freely determined.

According to embodiments of the present invention, the problems associated with increasing the size and resolution of an organic light emitting display can be reduced or solved by separating the initialization period and the threshold voltage compensation period from each other, and the threshold voltage of the driving transistor is compensated for so that an image with a uniform brightness can be displayed.

Although the detailed specification and the drawings have been limited to the NMOS transistor, they may be applicable to the case of using a PMOS transistor (PMOS-inverted OLED structure).

While the present invention has been described in connection with certain exemplary embodiments, it is to be understood that the invention is not limited to the disclosed embodiments, but on the contrary is intended to cover various modifications and equivalent arrangements included within the spirit and scope of the appended claims, and equivalents thereof.

What is claimed is:

1. A pixel circuit comprising:

an organic light emitting diode;

a second transistor comprising a gate terminal, a first terminal, and a second terminal coupled to a first scan line, a data line, and a first node, respectively;

a fourth transistor comprising a gate terminal, a first terminal, and a second terminal coupled to a third scan line, the first node, and a second node, respectively;

a third transistor comprising a gate terminal, a first terminal, and a second terminal coupled to a second scan line, a reference power source, and the second node, respectively;

a fifth transistor comprising a gate terminal, a first terminal, and a second terminal coupled to a light emission control line, a third node, and an anode of the organic light emitting diode, respectively;

a first capacitor coupled between the first node and the second node;

a second capacitor coupled between the second node and the third node; and a first transistor comprising a gate terminal, a first terminal, and a second terminal coupled to the first node, a first power source, and the third node, respectively, the first transistor being configured to supply a current to the organic light emitting diode.

2. The pixel circuit of claim 1, wherein the pixel circuit is configured to sequentially receive a first scan signal, a second scan signal, and a third scan signal from the first, second, and third scan lines, respectively.

3. The pixel circuit of claim 2, wherein the pixel circuit is configured to receive the second scan signal one horizontal time period after a start of the first scan signal, and to receive the third scan signal two horizontal time periods after a start of the second scan signal.

4. The pixel circuit of claim 1, wherein the second transistor is configured to apply a data signal from the data line to the first node when a first scan signal is applied to the first scan line.

5. The pixel circuit of claim 1, wherein the third transistor is configured to apply a voltage of the first power source to the second node when a second scan signal is applied to the second scan line.

6. The pixel circuit of claim 1, wherein the fourth transistor is configured to electrically couple the first node and the second node when a third scan signal is applied to the third scan line.

7. The pixel circuit of claim 2, wherein the fifth transistor is configured to supply the current to the organic light emitting diode when a light emission control signal is applied to the light emission control line.

8. The pixel circuit of claim 7, wherein the pixel circuit is configured:

to receive, during a first period, a data signal from the data line, the first scan signal, the second scan signal, and the light emission control signal each having a first voltage level, and the third scan signal having a second voltage level;

to receive, during a second period, the first scan signal, the third scan signal, and the light emission control signal each having the second voltage level, and the second scan signal having the first voltage level; and to receive, during a third period, the light emission control signal having the first voltage level, and the first scan signal, the second scan signal, and the third scan signal each having the second voltage level.

9. The pixel circuit of claim 8, wherein the first voltage level is a turn-on voltage level of the first, second, third, fourth, and fifth transistors, and the second voltage level is a turn-off level of the first, second, third, fourth, and fifth transistors.

10. The pixel circuit of claim 1, wherein the first, second, third, fourth, and fifth transistors are N-type metal oxide semiconductor transistors.

11. An organic light emitting display comprising:

a scan driver configured to supply scan signals to scan lines and to supply light emission control signals to light emission control lines;

a data driver configured to supply data signals to data lines; and a plurality of pixel circuits each located at crossing regions of the scan lines, the light emission control lines, and the data lines, wherein each of the pixel circuits comprises:

an organic light emitting diode;

a second transistor comprising a gate terminal, a first terminal, and a second terminal coupled to a first scan line of the scan lines, a data line of the data lines, and a first node, respectively;

a fourth transistor comprising a gate terminal, a first terminal, and a second terminal coupled to a third scan line of the scan lines, the first node, and a second node, respectively;

a third transistor comprising a gate terminal, a first terminal, and a second terminal coupled to a second scan line of the scan lines, a reference power source, and the second node, respectively;

a fifth transistor comprising a gate terminal, a first terminal, and a second terminal coupled to a light emission control line of the light emission control lines, a third node, and an anode of the organic light emitting diode, respectively;

a first capacitor coupled between the first node and the second node;

a second capacitor coupled between the second node and the third node; and a first transistor comprising a gate terminal, a first terminal, and a second terminal coupled to the first node, a first power source, and the third node, respectively, the first transistor being configured to supply a current to the organic light emitting diode.

12. The organic light emitting display of claim 11, wherein the scan driver is configured to sequentially output first, second, and third scan signals from among the scan signals from the first, second, and third scan lines, respectively.

13. The organic light emitting display of claim 12, wherein the scan driver is configured to output the second scan signal after delaying the second scan signal for one horizontal time period after a start of the first scan signal, and to output the third scan signal after delaying the third scan signal for two horizontal time periods after a start of the second scan signal.

14. The organic light emitting display of claim 11 further comprising emission control lines, wherein the scan driver, the data driver, and the emission control driver are configured to:

during a first period where a data signal is applied from the data line, apply a first scan signal from among the scan signals, a second scan signal from among the scan signals, and a light emission control signal from among the light emission control signals, each of the first scan signal, the second scan signal, and the light emission control signal having a first voltage level, and apply a third scan signal having a second voltage level from among the scan signals;

during a second period, apply the first scan signal, the third scan signal, and the light emission control signal each having the second voltage level, and apply the second scan signal having the first voltage level; and during a third period, apply the light emission control signal having the first voltage level, and apply the first scan signal, the second scan signal, and the third scan signal each having the second voltage level.

15. The organic light emitting display of claim 14, wherein the first voltage level is a turn-on level of the first, second, third, fourth, and fifth transistors, and the second voltage level is a turn-off level of the first, second, third, fourth, and fifth transistors.

16. A method of driving a pixel circuit which comprises: an organic light emitting diode; a second transistor comprising a gate terminal, a first terminal, and a second terminal coupled to a first scan line, a data line, and a first node, respectively; a fourth transistor comprising a gate terminal, a first terminal, and a second terminal coupled to a third scan line, the first node, and a second node, respectively; a third transistor comprising a gate terminal, a first terminal, and a second terminal coupled to a second scan line, a reference power source, and the second node, respectively; a fifth transistor comprising a gate terminal, a first terminal, and a second terminal coupled to a light emission control line, a third node, and an anode of the organic light emitting diode, respectively; a first capacitor coupled between the first node and the second node; a second capacitor coupled between the second node and the third node; and a first transistor comprising a gate terminal, a first terminal, and a second terminal coupled to the first node, a first power source, and the third node, respectively, the first transistor being configured to supply a current to the organic light emitting diode, the method comprising:

writing data to the pixel circuit and initializing the pixel circuit by applying a data signal from the data line, and turning on the second, third, and fifth transistors, and turning off the fourth transistor, wherein the second, third, and fifth transistors are turned on by respectively applying a first scan signal, a second scan signal and a light emission control signal each having a first voltage level, and the fourth transistor is turned off by applying a third scan signal having a second voltage level;

compensating for a threshold voltage of the first transistor by turning off the second transistor, the fourth transistor, and the fifth transistor and turning on the third transistor, wherein the second transistor, the fourth transistor, and the fifth transistor are turned off by respectively applying the first scan signal, the third scan signal, and the light emission control signal each having the second voltage level, and the third transistor is turned on by applying the second scan signal having the first voltage level; and lighting the organic light emitting diode by turning on the fifth transistor and turning off the second, third, and fourth transistors, wherein the fifth transistor is turned on by applying the light emission control signal having the first voltage level, and the second, third, and fourth transistors are turned off by respectively applying the first scan signal, the second scan signal, and the third scan signal each having the second voltage level.

17. The method of claim 16, wherein the first voltage level is a turn-on level of the first, second, third, fourth, and fifth transistors, and the second voltage level is a turn-off level of the first, second, third, fourth, and fifth transistors.

18. The method of claim 16, wherein the first, second, and third scan signals are sequentially applied.

19. The method of claim 16, wherein the second scan signal is applied one horizontal time period after a start of the first scan signal, and the third scan signal is applied two horizontal time periods after a start of the second scan signal.

20. The method of claim 16, wherein the first, second, third, fourth, and fifth transistors are N-type metal oxide semiconductor transistors.

* * * * *